US005423538A

United States Patent [19]

Stewart

[11] Patent Number: 5,423,538

[45] Date of Patent: Jun. 13, 1995

[54] GOLF STROKE PRACTICE DEVICE

[76] Inventor: Freddie O. Stewart, 3105 Wood Way #3, Gulf Breeze, Fla. 32561

[21] Appl. No.: 179,347

[22] Filed: Jan. 10, 1994

[51] Int. Cl.[6] ..... A63B 69/36

[52] U.S. Cl. ..... 273/183.1; 273/186.1; 273/187.1; 434/252

[58] Field of Search ..... 273/35 R, 186.1, 187.1, 273/183.1; 434/252

[56] References Cited

U.S. PATENT DOCUMENTS

| | | | |
|---|---|---|---|
| 3,776,555 | 12/1973 | Hagaman | 434/252 X |
| 4,180,270 | 12/1979 | Long | 273/186.1 |
| 4,304,406 | 12/1981 | Cromarty | 273/186.1 |
| 4,477,079 | 10/1984 | White | 273/186.1 |
| 5,040,790 | 8/1991 | Anthes et al. | 273/446 |
| 5,082,281 | 1/1992 | Berghofer | 273/183.1 |
| 5,108,105 | 4/1992 | Shimizu | 273/186.1 |
| 5,111,410 | 5/1992 | Nakayama et al. | 364/551.01 |
| 5,114,150 | 5/1992 | Matsumura | 273/186 R |
| 5,246,232 | 9/1993 | Eccher et al. | 273/184 R |
| 5,257,084 | 10/1993 | Marsh | 356/28 |

*Primary Examiner*—Vincent Millin
*Assistant Examiner*—Kerry Owens
*Attorney, Agent, or Firm*—James W. Hellwege

[57] ABSTRACT

A device for aiding in practicing of a golf stroke. A first adjustable signal means produces a first delayed sensible signal at a selectable first time period after the beginning of the backstroke, and a second adjustable signal means produces a second delayed sensible signal at an independently selectable second time period after the first delayed sensible signal. The first time period is adjusted or selected to correspond to the duration of the backswing for the individual golfer, while the second time period is selected to correspond to the duration of the downstroke until contact with the ball.

2 Claims, 1 Drawing Sheet

GOLF STROKE PRACTICE DEVICE

The invention relates to the art of golf practice devices, and more particularly to such devices designed to assist in developing a sound, repeating golf swing tailored to the individual user.

Numerous suggestions have been made in the prior art for devices designed to aid in developing a golf swing, some featuring devices such as arm braces, club head speed measuring devices, metronomes, etc. None of these has achieved widespread acceptance, apparently because of limited utility to accomplish the desired result.

According to the invention, these and other disadvantages of the prior art are avoided by provision of a novel and improved device for practicing a golf stroke tailored to the individual user.

According to a first prima aspect of the invention, there is provided a device for practicing with a golf club a golf stroke with a golf ball resting on a surface, the club comprising a club head having a striking face. The stroke comprises swinging the club head from the address position behind the ball in a backstroke having a beginning at the address position to a desired maximum point, then swinging the club head in a forward stroke until after the face strikes the ball. The device comprises a first delayed adjustable signal means for producing a first sensible signal at a first selectable first time period after the beginning of the backstroke, and a second adjustable signal means For producing a second delayed sensible signal means at an independently selectable second time period after the first sensible signal.

According to a second major aspect of the invention, there is provided a device for practicing with a putter the putting stroke with a golf ball resting on a putting surface, the putter comprising a head having a striking face. The stroke comprises swinging the putter head from the address position behind the ball in a backstroke having a beginning at the address position to a maximum rearmost point, then swinging the putter head in a forward stroke until after the face strikes the ball. The device comprises a first adjustable signal means for producing a first delayed sensible signal at a selectable first time period after the beginning of the backstroke, and second adjustable signal means for producing a second delayed sensible signal at an independently selectable time period after the first sensible signal.

According to another aspect of the invention as related to either of the above principal aspects, the first time period is longer than the second time period.

According to another aspect of the invention as related to either of the above principal aspects, the device further comprises disable means for preventing operation of the first adjustable signal means until the beginning of the backstroke.

According to another aspect of the invention as related to either of the above principal aspects, the disable means comprises means for detecting the presence of the head at the address position and thereby disabling the first adjustable signal means.

According to another aspect of the invention, the first sensible signal is produced at the end of the backstroke.

Other aspects will in part appear hereinafter and will in part be apparent from the following detailed description taken together with the accompanying drawing, wherein.

Figure 1:
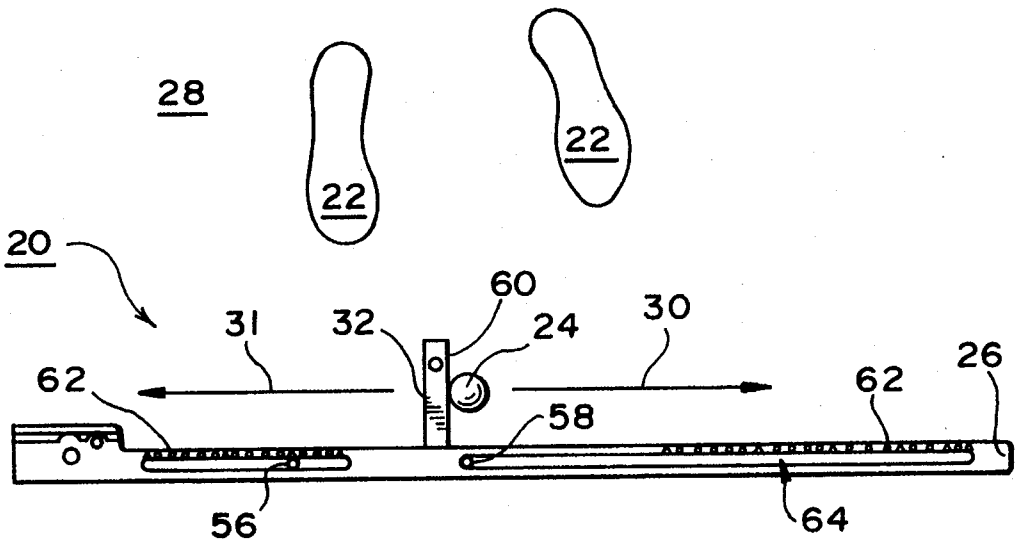
FIG. 1 is a schematic plan view of the preferred embodiment of the invention.

FIG. 1 illustrates the general arrangement of the preferred embodiment of device 20 according to the invention in relation to the golfer's footprints 22 and golf ball 24. Device 20 as illustrated comprises elongated tube 26 lying on putting surface 28 alongside and parallel to line 30 along which it is desired to propel ball 24. Club head 32 is illustrated in the address position just behind ball 24, immediately prior to beginning the backswing. The club of which club head 32 is a part is preferably a putter, but according to the broader aspects of the invention may be any other golf club, The shaft and handle portions of the golf club attached to the head 32 are conventional, and accordingly are not illustrated.

Figure 2:
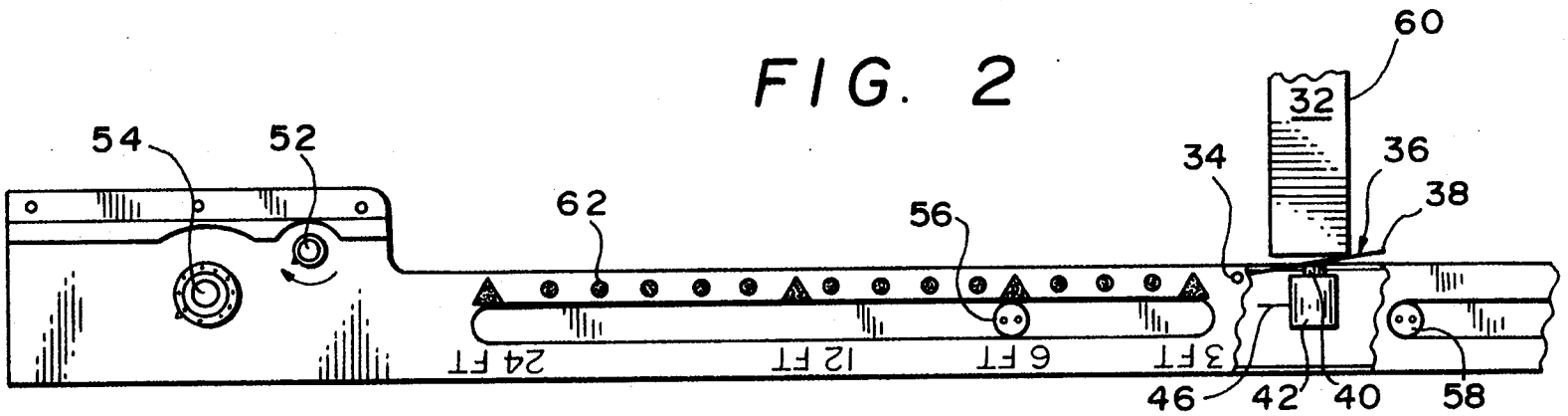
FIG. 2 is an enlarged view, partly broken away, of a portion of the FIG. 1 embodiment.

FIG. 2 illustrates an enlarged view, partly broken away, of the portion of tube 26 adjacent ball 24 and club head 32. Leftmost end 34 of finger or reed 36 is pivotally mounted on tube 26, while rightmost end 38 is biassed to extend upwardly as viewed in FIG. 2, bearing against the toe of club head 32. The intermediate portion of finger 36 bears against and depresses actuator of microswitch 42 so long as club head 32 is in the address position. Microswitch 42 detects removal of club head 32 and accordingly the beginning of the backstroke, and may itself by means of actuator 40 provide the noted upward biassing.

Figure 3:
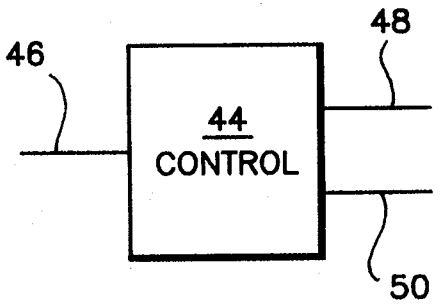
FIG. 3 is a block diagram of the control circuitry of the FIG. 1 embodiment.

The leftmost end of tube 26 encloses control circuitry 44 of FIG. 3. Control circuitry 44 comprises input terminal 46 and first and second output terminals 48 and 50. Adjusting knobs 52 and 54 are mounted on the leftmost end of tube 26 for adjusting control circuitry 44 as described below.

Indicator 56 is driven by output terminals 48 and 50, and is shown as movably mounted on tube 26. Indicator 56 produces when actuated a sensible signal, that is, a signal which can be detected by the golfer, such as a visual or audible signal. Indicator 56 may be located to indicate the desired length of backstroke from the vicinity of finger 36.

Usage and operation of device 20 is as follows. With club head 32 in the address position as illustrated, switch 42 will be actuated, producing a disable signal on conductor 46 (FIGS. 2 and 3). When the backswing begins, finger 36 and actuator 40 will be released, ending the disable signal on conductor 46. Control circuitry 44, previously disabled and reset by the presence of the disable signal on conductor 46, responds by counting toward a first value as determined by the setting of adjusting knob 52, and, upon attaining the first value after a first time period as determined by the adjustment or setting of knob 52, produces an output signal on terminal 48 which drives indicator 56 to produce a first delayed sensible output signal. Knob 52 is preferably adjusted such that the first delayed sensible signal is delayed until the end of the individual golfer's backswing. As described in this paragraph, there is thus provided a first adjustable signal means for producing a first delayed sensible signal at an adjustable or selectable first time period after the beginning of the backstroke, the first time period corresponding to the duration of the golfer's backstroke. Even though the length of the backstroke increases with increases in the desired length of the putt, the duration of the backstroke tends to be substantially constant for a given golfer, particularly for the putting stroke when the golfer is putting well, and is substantially independent of the length of the putt.

After production of the first delayed sensible signal, control circuitry 44 continues counting toward a second value as determined by the setting of adjusting knob 54, and, upon attaining the second value, produces an output on terminal 50 which drives indicator 58 to produce a second delayed sensible output signal. Indicator 58 may be adjusted along the illustrated slot such that the second sensible signal at indicator 58 corresponds to any point in the forward stroke from the striking of ball 24 with face 60 of club head 32 to the follow through point indicated at 64. There is thus provided a second adjustable signal means for producing a second delayed sensible signal at an independently selectable time period after production of the first sensible signal,the independently selectable time period corresponding to any desired point in the fort,yard stroke, from striking of ball 24 through the followthrough. As with the backstroke, the duration of the forward stroke tends to be substantially constant for a given golfer, and is substantially independent of the length of putt.

While the majority of the above disclosure has been directed toward the putting stroke, the apparatus of the invention may also be used for practicing strokes with other clubs. The apparatus illustrated is readily adaptable to the left-handed golfer, who would stand on the opposite side of tube 26 and use the heel instead of the toe of club head 32 at reed or finger 36.

A series of lights 62 may be sequentially illuminated alongside of and in time with the movement of the clubhead, during all or part of the backstroke, the forward stroke and the followthrough, if desired as an additional practice aid.

While control circuitry 44 has been described as using a digital counter for determining the time periods, simple resistive-capacitive circuitry can be used in performing the timing functions.

I claim:

1. A device for practicing with a golf club a golf stroke with a golf ball resting on a surface, said club having a club head having a striking face, said stroke comprises swinging said club head from an address position behind said ball in a backstroke having a beginning at said address position to a desired maximum point at the end of said backstroke, then swinging said club head in a forward stroke until after said face strikes said ball, said device comprising:

stroke length indicating means including first and second indicia means for indicating a range of selectable backstroke and forward stroke lengths, first indicating means for indicating a preselected length of backstroke, said first indicating means movable with respect to said first indicia means, and second indicating means for indicating a preselected length of forward stroke measured from the point of club face to ball impact to completion of the forward stroke, said second indicating means movable with respect to said second indicia means;

control means for producing a first sensible signal after a first preselected time period has elapsed coinciding with a preselected point of the backstroke, said control means further producing a second sensible signal after a second preselected time period has elapsed, said second selectable time period being of longer duration than said first time period and coinciding with the end of said preselected length of forward stroke; and, club head sensing means for inhibiting said control means until movement of said club head occurs.

2. A device for practicing with a golf club a golf stroke with a golf ball resting on a surface, said club having a club head having a striking face, said stroke comprises swinging said club head from an address position behind said ball in a backstroke having a beginning at said address position to a desired maximum point at the end of said backstroke, then swinging said club head in a forward stroke until after said face strikes said ball, said device comprising:

a frame with a first range of indicia representative of selectable backstroke lengths and a second range of indicia representative of selectable forward stroke lengths;

a first movable indicator to indicate the end of a preselected backstroke length and a second movable indicator to indicate a preselected forward stroke length measured from a point of impact between the club head and the ball to the end of the forward stroke;

means for preselecting a first time period representative of time of backstroke and means for preselecting a second time period representative of forward stroke time;

a control means for producing a first sensible signal after said first preselected time period has elapsed coinciding with preselected point of the backstroke, said control means further producing a second sensible signal after said second preselected time period has elapsed, said second selectable time period being of longer duration than said first time period and coinciding with the end of said preselected length of forward stroke; and, club head sensing means for inhibiting said control means until movement of said club head occurs.

* * * * *